United States Patent [19]

Pan et al.

[11] Patent Number: 4,619,124

[45] Date of Patent: Oct. 28, 1986

[54] CYLINDER LOCK WITH ANTI-PICKING DEVICE

[76] Inventors: Yau-Jung Pan, 4th Fl., No. 22, Kan Chou St., Taipei; Sheng-Yi Chen, No. 33-1, Chung Hu Rd., 4 Lin, Ching Hu Village, Lin Kou Hsiang, both of Taiwan

[21] Appl. No.: 776,788

[22] Filed: Sep. 16, 1985

[51] Int. Cl.[4] ..... E05B 17/14; E05B 15/06

[52] U.S. Cl. ..... 70/419; 70/423; 70/455

[58] Field of Search ..... 70/419, 423, 368, 455, 70/421

[56] References Cited

U.S. PATENT DOCUMENTS

| | | | |
|---|---|---|---|
| 348,715 | 9/1886 | Bedford | 70/423 |
| 453,082 | 5/1891 | Hollyday | 70/455 |
| 650,556 | 5/1900 | Fischer | 70/423 |
| 734,541 | 7/1903 | Green et al. | 70/423 |
| 761,568 | 5/1904 | Wedler | 70/455 |
| 1,486,037 | 3/1924 | Rousseau | 70/455 |
| 2,462,954 | 3/1949 | Frizzell | 70/419 |
| 3,820,364 | 6/1974 | Greeley | 70/423 |
| 3,857,264 | 12/1974 | Fowler | 70/423 |
| 4,031,730 | 6/1977 | Kern | 70/423 |
| 4,277,962 | 7/1981 | Lipschutz | 70/423 |

*Primary Examiner*—Gary L. Smith
*Assistant Examiner*—Suzanne L. Dino
*Attorney, Agent, or Firm*—Robert B. Frailey

[57] ABSTRACT

This disclosure relates a cylinder lock with anti-picking device. A shaft is provided to extend into the keyway of the lock to prevent the entry of any foreign object. Only when a special tool is used to retract the shaft can a key be inserted into the keyhole, thereby eliminating the risk of picking by unauthorized persons.

3 Claims, 3 Drawing Figures

CYLINDER LOCK WITH ANTI-PICKING DEVICE

This invention relates to a cylinder lock with anti-picking device.

Conventional cylinder locks suffer the disadvantage that they are prone to be picked by an unauthorized person by a skeleton key or merely a wire.

Accordingly, it is the chief object of this invention to provide an anti-picking mechanism for cylinder lock, whereby even an adroit lock-picker finds it difficult to pick the lock.

According to the present invention, a locking device is provided, which comprises a shaft extending into the passage of the keyway of the cylinder (rotor) to prohibit the entry of any foreign object into the keyhole, and a special tool to retract the shaft from the keyway so as to allow the insertion of a key to unlock the lock. Practically, the shaft is retained in a tunnel extending in the radial direction of the cylinder to shift between a first position in which its end extends into the keyway of the cylinder, and a second position in which it is fully retracted away from the cylinder. A length of the shaft defines a gear, which is in engagement with a worm. The worm has a shaped end which matches the special tool and can be driven thereby.

Hence to open the lock, the user must have a special tool besides a correct key. He must use the special too to retract the shaft, then insert the key into the keyhole. When unlocking the lock, after pushing the hook into locking position, he still has to use the special tool to push the shaft to the keyway. If one doesn't drive the shaft back to the keyway, the lock merely functions as an ordinary cylinder lock. The special tool can be formed as an integral part or undetachable part of the key.

This invention will be better understood when read in connection with the accompanying drawing in which:

DETAILED DESCRIPTION OF PREFERRED EMBODIMENT

Figure 1:
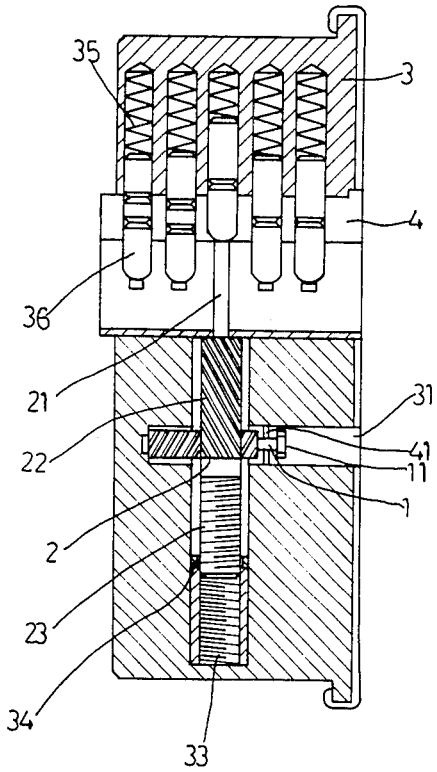
FIG. 1 is a sectional view of a lock provided with the anti-picking mechanism according to this invention, wherein the keyway is blocked by the shaft.
Figure 2:
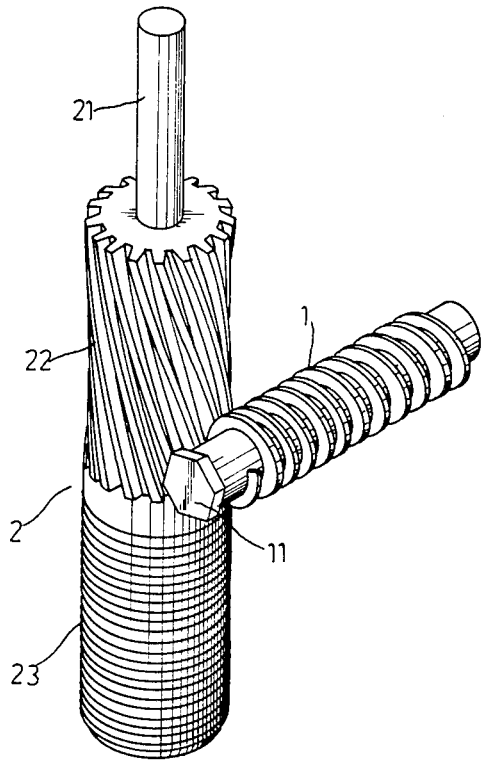
FIG. 2 is a perspective view of the mechanism.
Figure 3:
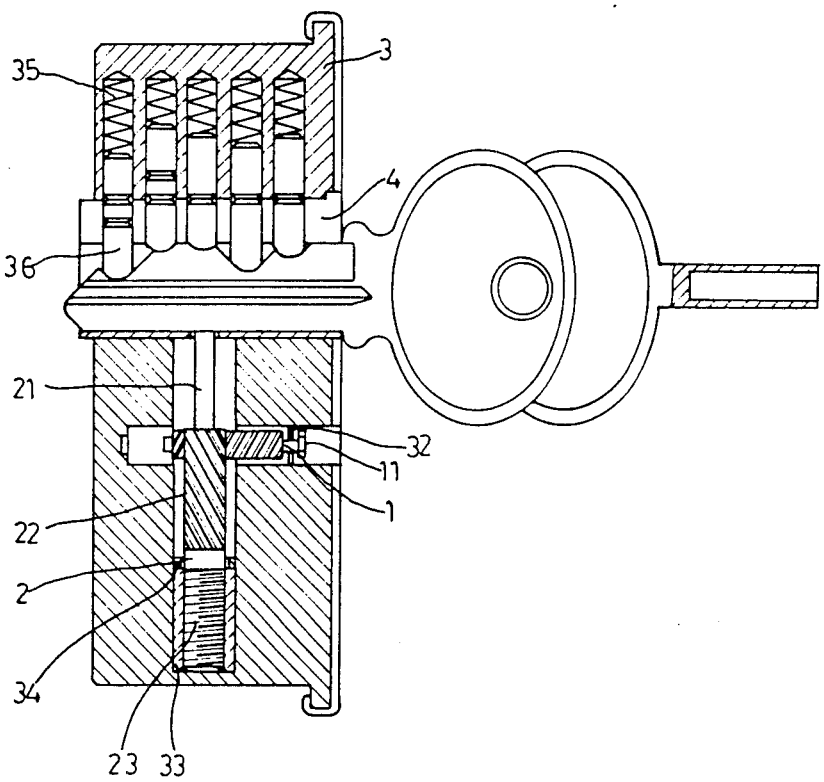
FIG. 3 shows the anti-picking mechanism in retracted position.

With reference to FIG. 1, like ordinary cylinder locks, the lock according to this invention comprises a body (3) and a cylinder (4) with a plurality of spring-loaded pin tumblers (36) biased by springs (35). The functions of these parts are the same as that of conventional cylinder locks. The feature of this invention consists in a shaft (2) which comprises three sections, namely a blocking end (21), a middle section (22) forming as an integral part of the shaft and in the form of a gear engaging with a worm (1), and a threaded end (23) in engagement with a projection (34). The shaft is retained in a tunnel (33) extending in the radial direction of the cylinder (4). The blocking end (21) extends into the keyway to prevent any foreign object (for example, a wire or a skeletal key) extering the keyhole. The worm (1) is retained in a second tunnel (31) and prevented to make any axial shift by a flange. The worm has a working end (11) can be of, for example, square, rectangular, triangular, or hexagonal configuration (see inset of FIG. 3). In use, one must at first drive the special tool into the tunnel (31) so that the special tool engages with the working end (11), then he can drive the worm (1) by rotating the tool. The shaft (2) is driven to rotate around its own axis. Since its threaded section (23) is in engagement with the projection (34), it moves downwardly, and its blocking end (21) is retracted from the keyway (see FIG. 3). Now the keyway is available for the entry of the key.

The special tool can be formed as an integral or undetachable part of the key, or merely tied to the same keyring with the key.

I claim:

1. A cylinder lock with a body, a cylinder rotatably retained in said body with a keyhole extending into the cylinder to define a keyway and a plurality of spring-loaded pin tumblers, characterized in that it further comprises a mechanism to prevent a foreign object from entering said keyway, said mechanism comprising a shaft and a worm; said shaft being retained in a first tunnel in said body extending in the radial direction of said cylinder to rotate around its own axis and to shift between a first position in which one of its end extends into said keyway and a second position in which its said end is fully retracted from said keyway;

said shaft comprising three sections, including a first section for extending into the range of said keyway, a second section provided with equidistant ridges spaced around its periphery to define a gear to engage with said worm, and a threaded third section;

said first tunnel being provided with means to engage with said threaded third section so that the rotation of said shaft around its own axis is accompanied by an axial movement along its axial direction;

said worm being retained in a second tunnel perpendicular to said first tunnel to rotate around its own axis, said second tunnel having an opening on the surface of said lock, the end of said worm facing to the opening being shaped to adapt to a special tool.

2. The lock according to claim 1, wherein said special tool has at least a portion shaped to mate with said shaped end of said worm so as to drive said worm by operating said tool.

3. The lock according to claim 2, further comprising a key to unlock the lock, characterised in that said tool is formed as an undetachable part of said key.

* * * * *